US008678702B1

(12) United States Patent
De Jong

(10) Patent No.: US 8,678,702 B1
(45) Date of Patent: Mar. 25, 2014

(54) GRAVEL GRADER

(71) Applicant: James De Jong, Hull, IA (US)

(72) Inventor: James De Jong, Hull, IA (US)

( * ) Notice: Subject to any disclaimer, the term of this patent is extended or adjusted under 35 U.S.C. 154(b) by 0 days.

(21) Appl. No.: 13/771,337

(22) Filed: Feb. 20, 2013

(51) Int. Cl.
*E01C 19/15* (2006.01)

(52) U.S. Cl.
USPC ..... 404/85; 404/118; 404/119

(58) Field of Classification Search
USPC ..... 404/85, 103, 106, 117, 118, 119
See application file for complete search history.

(56) References Cited

U.S. PATENT DOCUMENTS

| | | | | |
|---|---|---|---|---|
| 1,532,841 | A | 4/1925 | Stayton et al. | |
| 1,909,458 | A * | 5/1933 | Dieckmann | 404/119 |
| 1,924,572 | A | 8/1933 | Samuel | |
| 2,566,641 | A | 9/1951 | Sinead | |
| 2,832,273 | A | 4/1958 | Calabrese | |
| 2,973,723 | A * | 3/1961 | Hudis et al. | 105/178 |
| 3,237,540 | A * | 3/1966 | Suhr | 404/106 |
| 3,453,988 | A * | 7/1969 | Kubitschek et al. | 118/103 |
| 4,289,421 | A * | 9/1981 | Sampey et al. | 404/106 |
| 4,379,683 | A * | 4/1983 | Rodgers et al. | 425/62 |
| 4,895,477 | A * | 1/1990 | Probst et al. | 404/119 |
| 4,995,760 | A * | 2/1991 | Probst et al. | 404/119 |
| 5,971,656 | A * | 10/1999 | Kitsmiller | 404/74 |
| 6,223,495 | B1 * | 5/2001 | Shaw et al. | 52/749.1 |
| 6,402,425 | B1 * | 6/2002 | Paladeni | 404/118 |
| 8,221,027 | B2 * | 7/2012 | Lura | 404/103 |

* cited by examiner

*Primary Examiner* — Raymond W Addie

(57) ABSTRACT

A gravel grading attachment assembly prepares gravel subgrade to a form prior to concrete placement. The assembly includes a main blade coupled to an attachment member to provide a straight bottom edge. First and second roller assemblies are coupled to and extend from the main blade. Each of a first roller and a second roller rotate in a plane substantially transverse to the straight bottom edge of the main blade. The first roller and the second roller rest upon spaced guide surfaces and the main blade is maintained at a consistent spacing relative to the guide surfaces as the first and second rollers are moved on the guide surfaces.

20 Claims, 8 Drawing Sheets

GRAVEL GRADER

BACKGROUND OF THE DISCLOSURE

Field of the Disclosure

The disclosure relates to grading devices and more particularly pertains to a new grading device for prepping a top surface of a gravel subgrade to a form prior to concrete placement.

SUMMARY OF THE DISCLOSURE

An embodiment of the disclosure meets the needs presented above by generally comprising an attachment member configured for coupling to a vehicle such as a skidsteer. A main blade is coupled to the attachment member providing a straight bottom edge to level an upper surface of gravel positioned in a frame as the main blade is moved over the gravel. A first roller assembly is coupled to and extends from the main blade. A first roller defines a bottom edge of the first roller assembly and rotates in a plane substantially transverse to the straight bottom edge of the main blade. A second roller assembly is coupled to and extends from the main blade. A second roller defines a bottom edge of the second roller assembly and rotates in a plane substantially transverse to the straight bottom edge of the main blade. The first roller and the second roller rest upon spaced guide surfaces and the main blade is maintained at a consistent spacing relative to the guide surfaces as the first and second rollers are moved on the guide surfaces.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
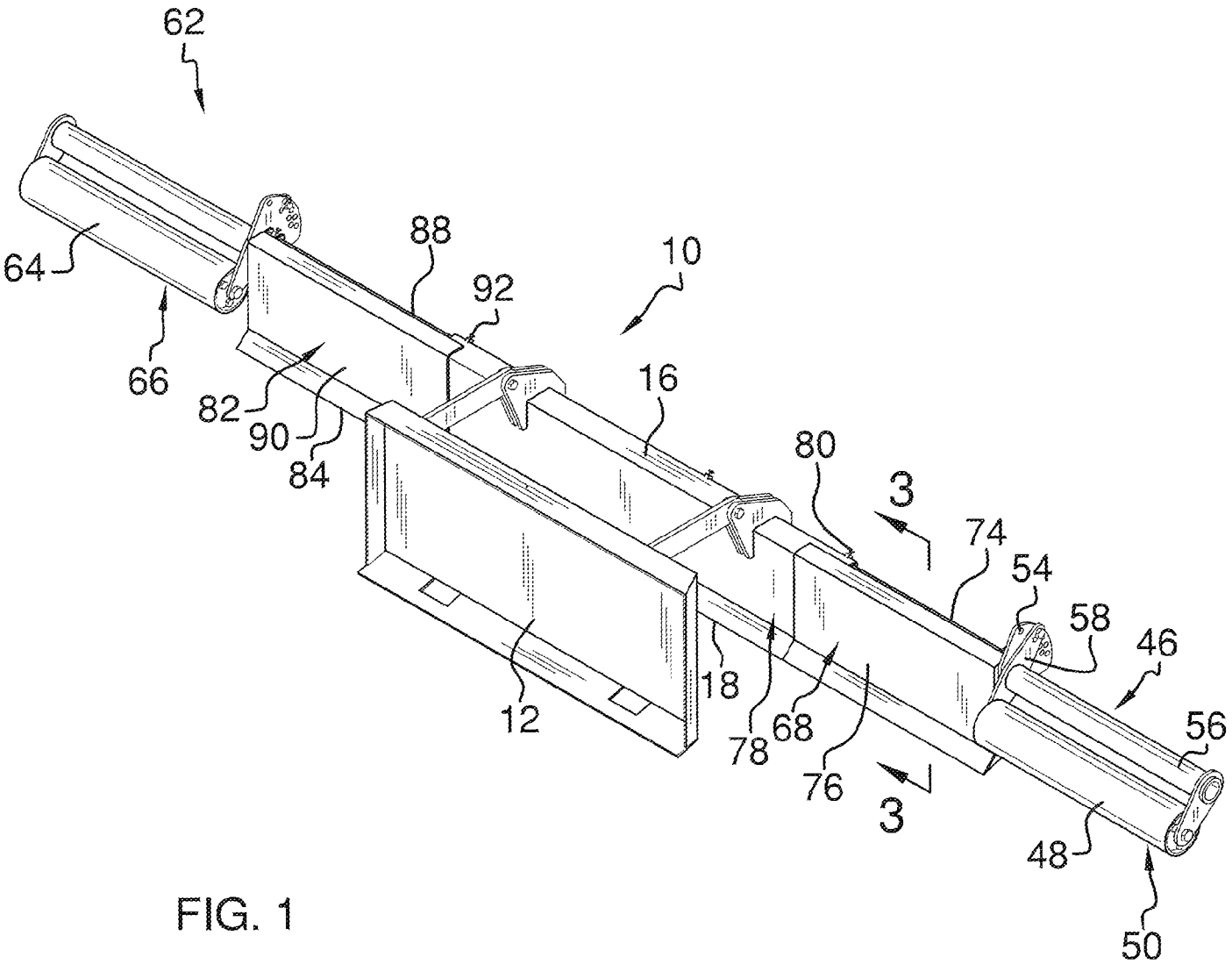
FIG. 1 is a top back side perspective view of a gravel grading attachment assembly according to an embodiment of the disclosure.
Figure 2:
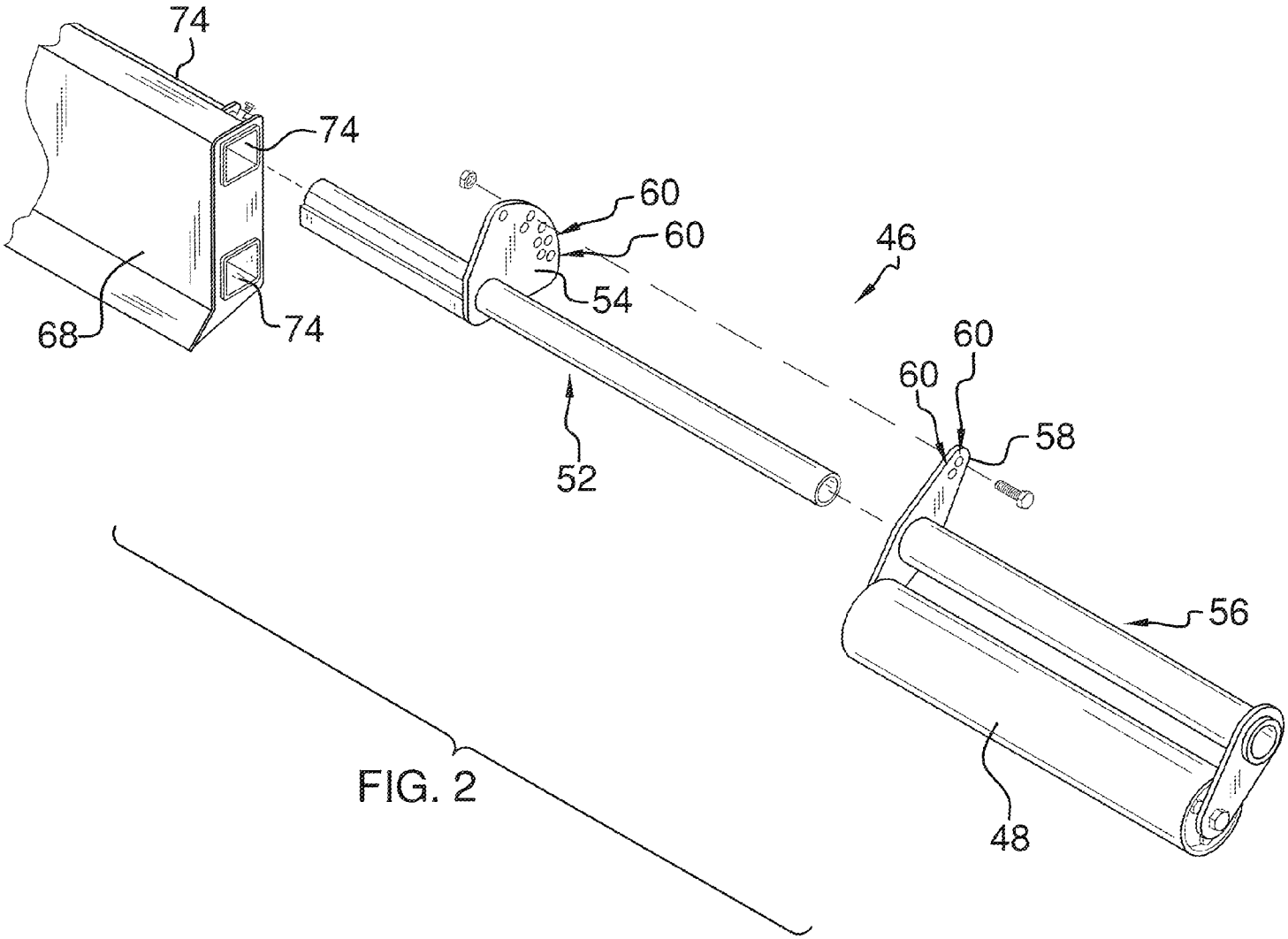
FIG. 2 is a partially exploded top back side detail view of an embodiment of the disclosure.
Figure 3:
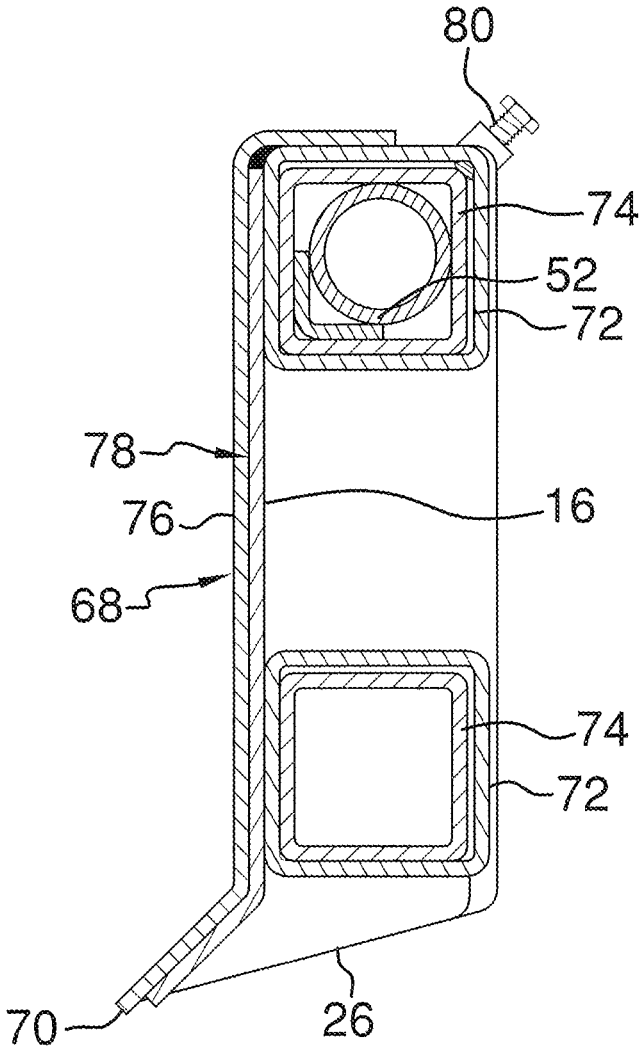
FIG. 3 is a cross-sectional view of an embodiment of the disclosure taken along line 3-3 of FIG. 1.
Figure 4:
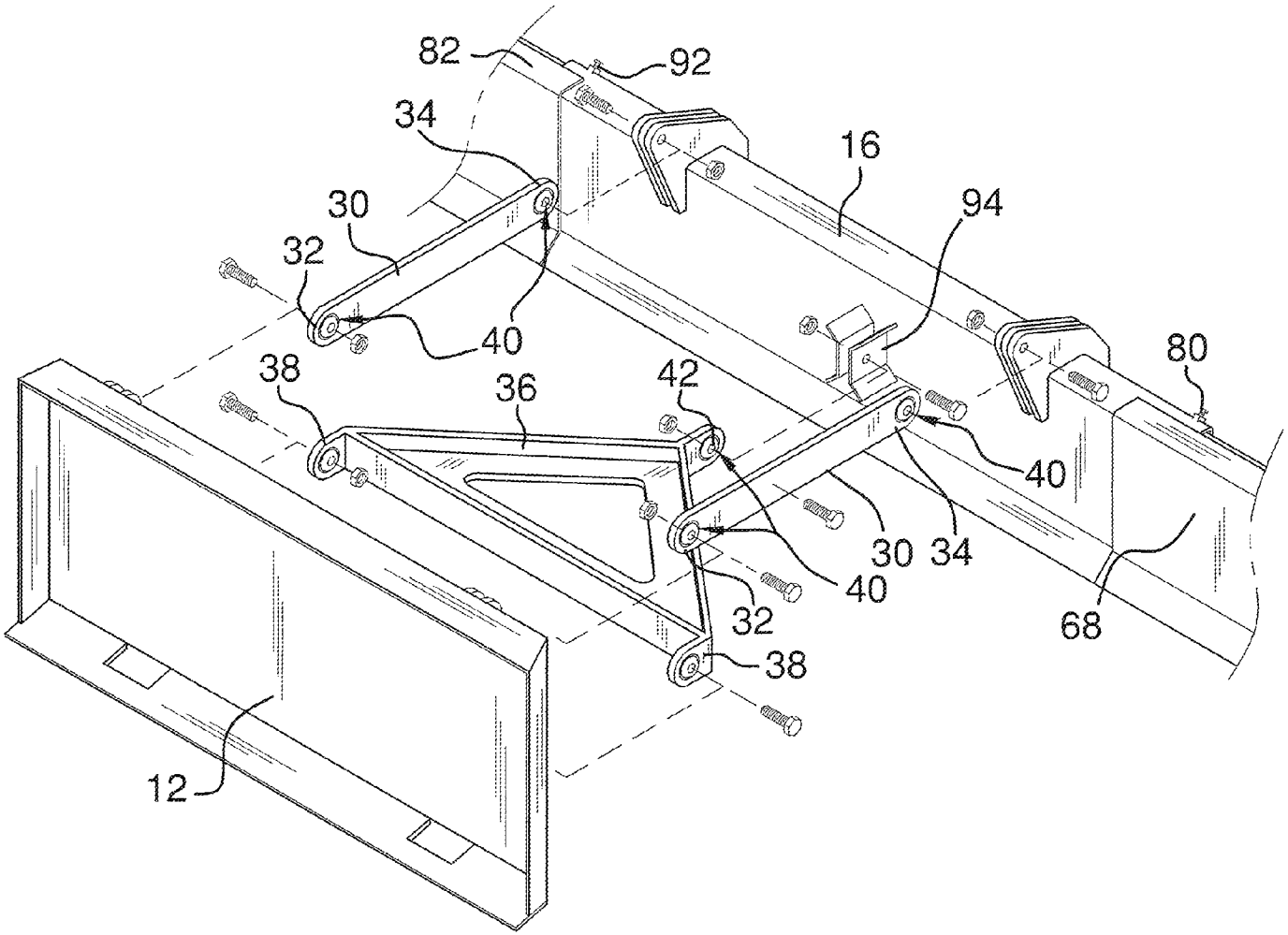
FIG. 4 is a partially exploded top back side view of an embodiment of the disclosure.
Figure 5:
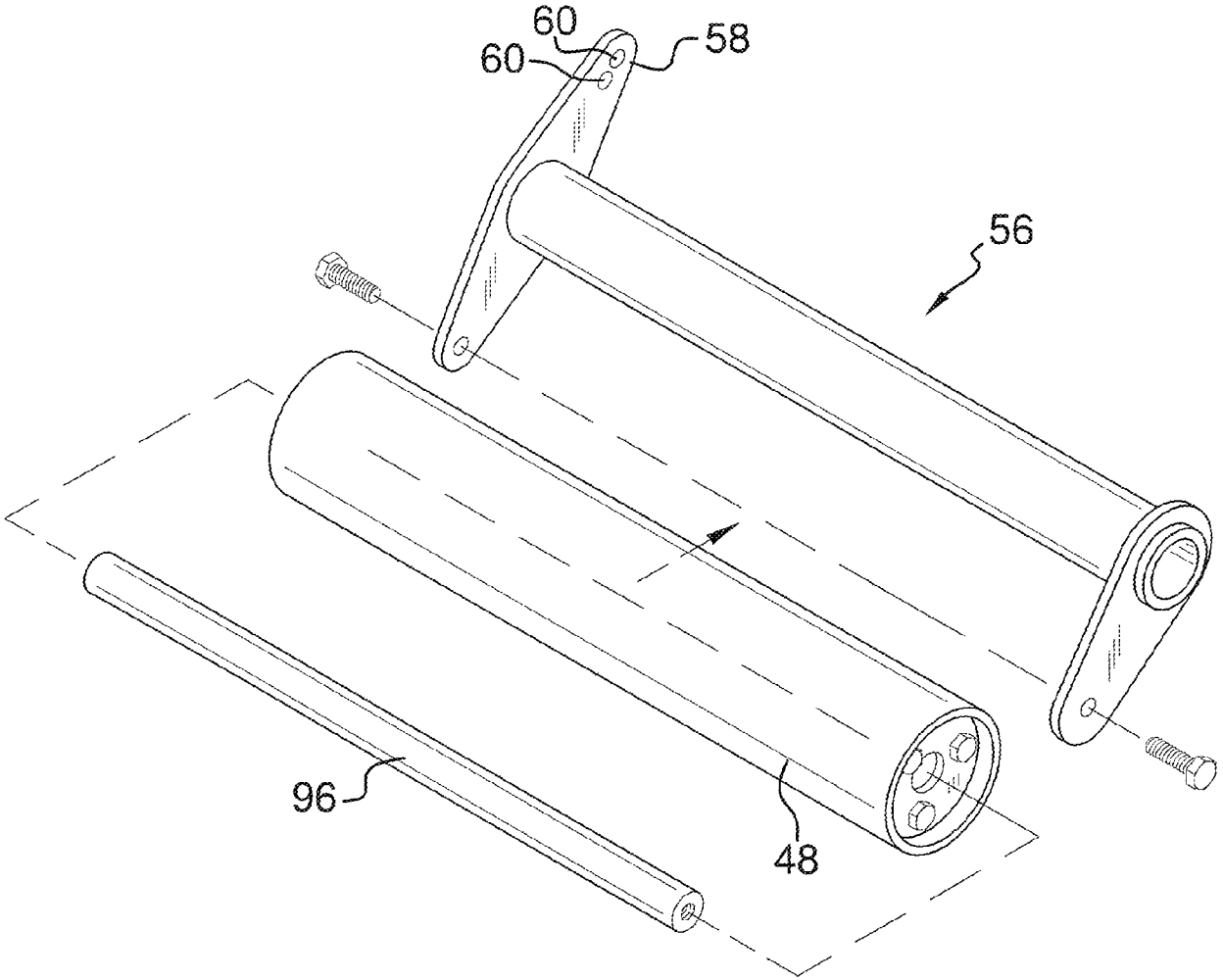
FIG. 5 is a partially exploded top back side view of a roller assembly of all embodiment of the disclosure.
Figure 6:
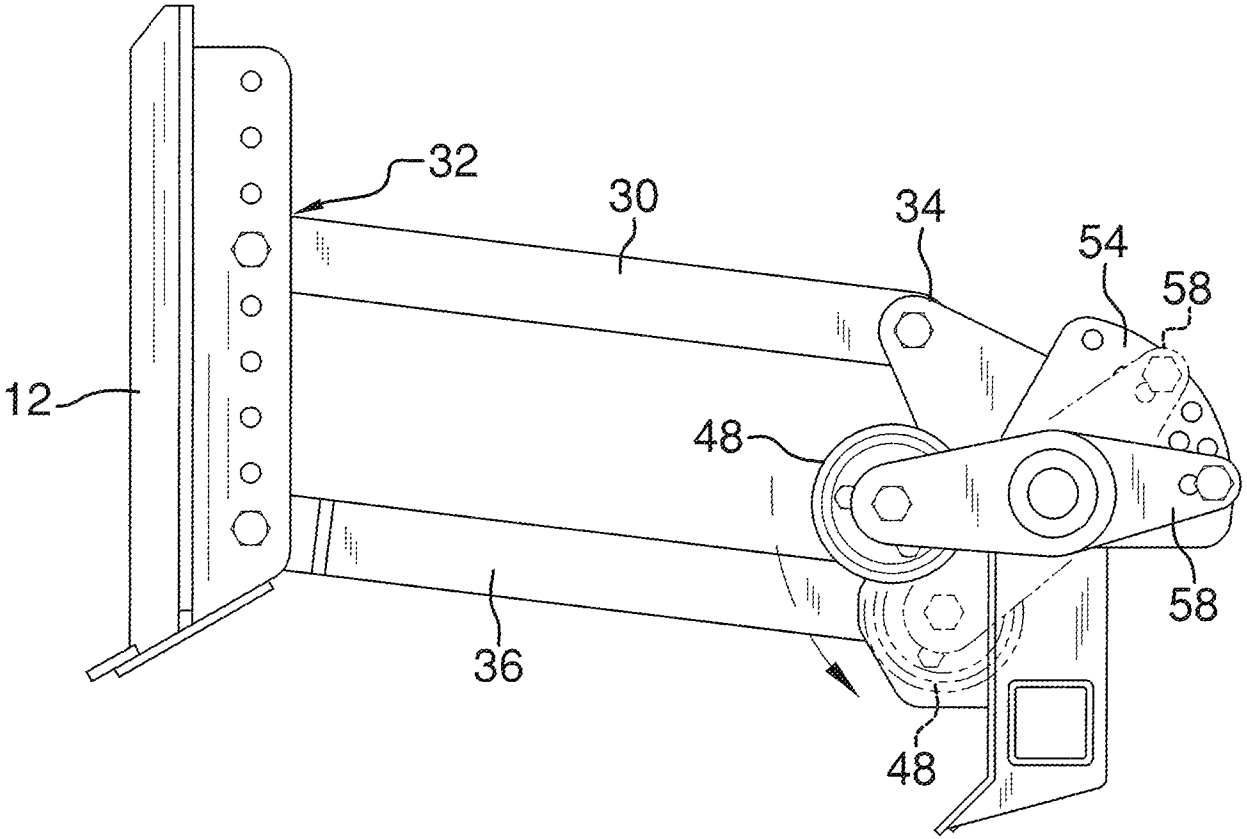
FIG. 6 is a side view of an embodiment of the disclosure.
Figure 7:
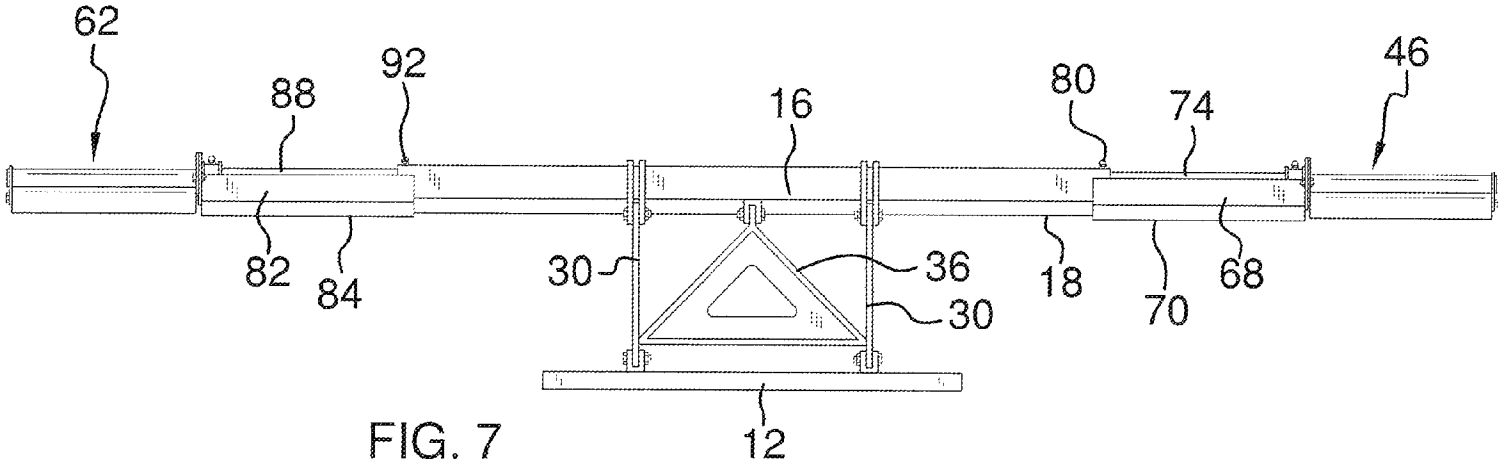
FIG. 7 is a top view of an embodiment of the disclosure.
Figure 8:
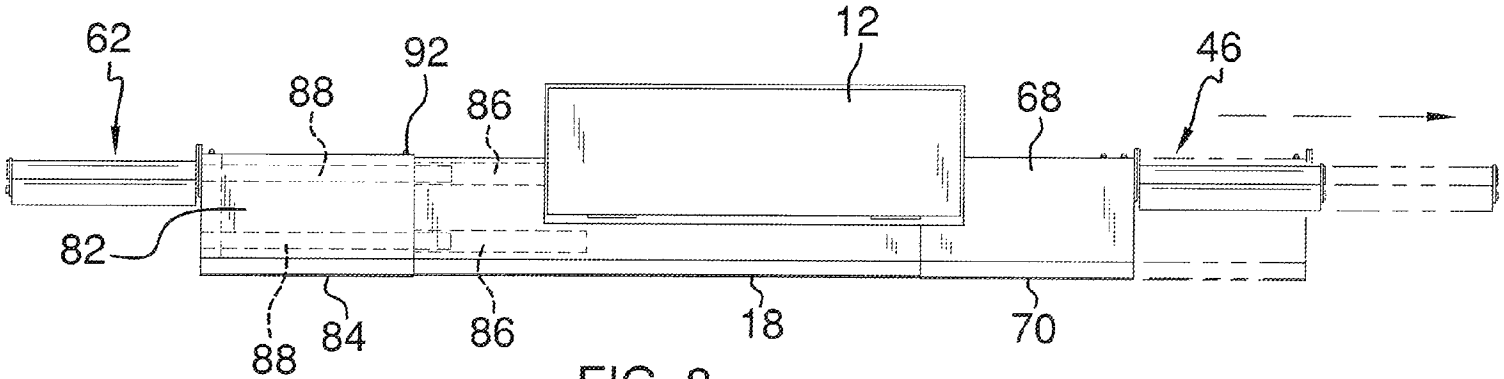
FIG. 8 is a back view of an embodiment of the disclosure.
Figure 9:
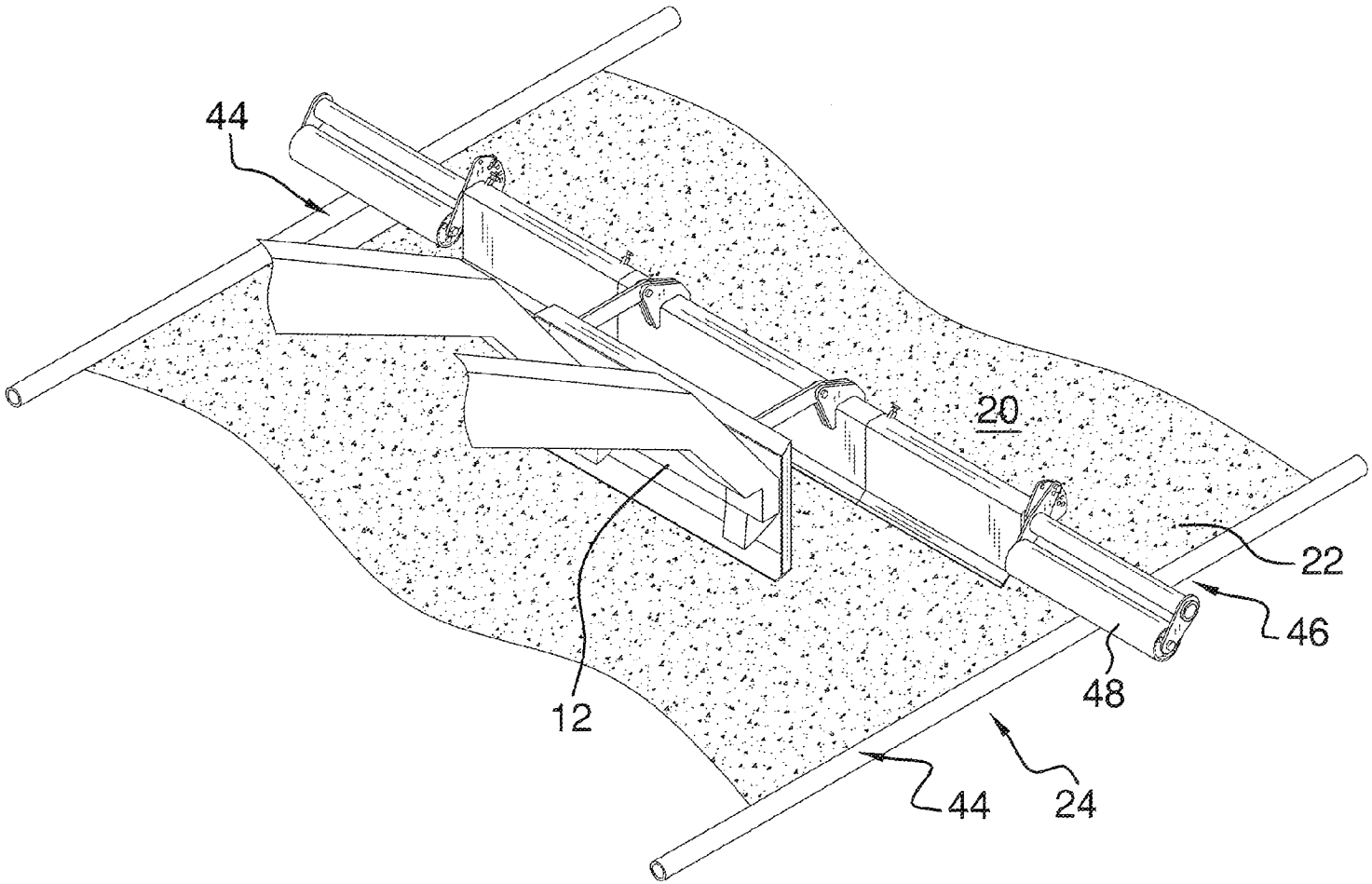
FIG. 9 is a top back side perspective view of an embodiment of the disclosure in use.

With reference now to the drawings, and in particular to FIGS. 1 through 9 thereof, a new grading device embodying the principles and concepts of an embodiment of the disclosure and generally designated by the reference numeral 10 will be described.

As best illustrated in FIGS. 1 through 9, the gravel grading attachment assembly 10 generally comprises an attachment member 12 configured for coupling to a vehicle such as a conventional skidsteer. The attachment member 12 couples to the skidsteer in a conventional manner. A main blade 16 is coupled to the attachment member 12. The main blade 16 has a straight bottom edge 18 wherein the main blade 16 is configured to level an upper surface 20 of gravel 22 positioned in a frame 24 when the main blade 16 is moved over the gravel 22. The frame 24 may be formed from wood and pipe in a conventional manner. A bottom surface 26 of the main blade 16 is angled such that the bottom surface 26 of the main blade 16 extends downwardly and towards the attachment member 12 approaching the straight bottom edge 18 of the main blade 16. A pair of pivot arms 30 couple the main blade 16 to the attachment member 12. Each pivot arm 30 has a first end 32 coupled to the attachment member 12 by a ball joint 40 and a second end 34 pivotally coupled to the main blade 16 by another ball joint 40. A triangular linkage member 36 has a pair of spaced connection ends 38 pivotally coupled to the attachment member 12. The linkage member 36 further has a blade end 42 coupled to a bracket 94 coupled to the main blade 16. The blade end 42 is coupled to the bracket 94 using another ball joint 40. Thus, the main blade 16 is configured to be essentially free floating for maintaining consistent spacing relative to the guide surfaces 44 provided by the frame 24 as described below.

A first roller assembly 46 is coupled to and extends from the main blade 16. The first roller assembly 46 comprises a first roller 48 defining a bottom edge 50 of the first roller assembly 46. The first roller 48 is positioned on an elongated bearing 96 such that the first roller 48 rotates in a plane substantially transverse to the straight bottom edge 18 of the main blade 16. The first roller assembly 46 further comprises an elongated fixed portion 52 coupled to and extending away from the main blade 16. A roller adjustment plate 54 is coupled to and extends from the fixed portion 52. A pivotable portion 56 is pivotally coupled to the fixed portion 52 by slidably inserting the fixed portion 52 into the pivotable portion 56. The first roller 48 is coupled to the pivotable portion 56 in parallel spaced relationship. A roller adjustment arm 58 is coupled to and extends from the pivotable portion 56 adjacent to the roller adjustment plate 54. The roller adjustment arm 58 is coupled to the adjustment plate 54 at a selectable position using radially arranged alignable apertures 60. The pivotable portion 56 supports the first roller 48 in a selected position relative to the bottom edge 18 of the main blade 16 when the roller adjustment arm 58 is coupled to the roller adjustment plate 54. A second roller assembly 62 is coupled to and extends from the main blade 16 in the same manner and utilizing the same structure as the first roller assembly 46 except that the second roller assembly 62 extends from an opposite side of the main blade 16 relative to the first roller assembly 46. Thus, the main blade 16 is positioned between the first roller assembly 46 and the second roller assembly 62. The second roller assembly 62 includes a second roller 64 defining a bottom edge 66 of the second roller assembly 62. The second roller 64 rotates in a plane substantially transverse to the straight bottom edge 18 of the main blade 16. Thus, the first roller 48 and the second roller 64 are configured to rest upon spaced guide surfaces 44 of the frame 24 such that the straight bottom edge 18 of the main blade 16 is maintained at a consistent spacing relative to the guide surfaces 44 as the first and second rollers 48,64 are moved on the guide surfaces 44. The second roller assembly 62 includes the same coupling structure as described above for the first roller assembly 46.

A first side blade 68 is coupled to the main blade 16 and the first roller assembly 46. The first side blade 68 extends between the main blade 16 and the first roller assembly 46. The first side blade 68 has a straight bottom edge 70 which is substantially coplanar with and an extension of the straight bottom edge 18 of the main blade 16. The first roller assembly 46 is adjustably coupled relative to the first side blade 68 such that a vertical distance between the bottom edge 70 of the first roller assembly 46 and the straight bottom edge 18 of the main blade 16 is adjustable as described above. The first side blade 68 is slidably coupled to the main blade 16 wherein a combined width of the main blade 16 and the first side blade 48 is adjustable. To achieve this, a pair of first side receivers 72 extends into the main blade 16. The first side blade 68 comprises a pair of spaced bars 74 coupled to a first blade face 76. The spaced bars 74 of the first side blade 68 are slidably inserted into the first side receivers 72 and the first blade face 76 is positioned adjacent to a main blade face 78 of the main blade 16. Thus, the first side blade 68 extends the main blade 16 and works in tandem with the main blade 16. A first side locking member 80 such as a locking screw or pin engages the main blade 16 and the first side blade 68 wherein the spaced bars 74 of the first side blade 68 are prevented from sliding in the first side receivers 72 when the first side locking member 80 is engaged.

Similarly, a second side blade 82 is coupled to the main blade 16 and the second roller assembly 62. The second side blade 82 extends between the main blade 16 and the second roller assembly 62. The second side blade 82 has a straight bottom edge 84 substantially coplanar with the straight bottom edge 18 of the main blade 16. The second roller assembly 62 is adjustably coupled relative to the second side blade 82 wherein a vertical distance between the bottom edge 66 of the second roller assembly 62 and the straight bottom edge 18 of the main blade 16 is adjustable. The second side blade 82 is slidably coupled to the main blade 16 wherein a combined width of the main blade 16 and the second side blade 82 is adjustable in the same manner as the first side blade 68 is adjusted and secured relative to the main blade 16. Thus, a pair of second side receivers 86 extends into the main blade 16 and the second side blade 82 comprises a pair of spaced bars 88 coupled to a second blade face 90. The spaced bars 88 of the second side blade 82 are slidably inserted into the second side receivers 86 wherein the second blade face 90 is positioned adjacent to the main blade face 78 of the main blade 16. A second side locking member 92 engages the main blade 16 and the second side blade 82 wherein the spaced bars 88 of the second side blade 82 are prevented from sliding in the second side receivers 86 when the second side locking member 92 is engaged.

The combined width of the first side blade 68, second side blade 82, and main blade 16 is adjustable between 2.25 meters and 3.75 meters. The first roller assembly 46 and second roller assembly 62 are each adjustable relative to the bottom edge 18 of the main blade 16 to provide for a depth between 8 centimeters and 20 centimeters below the guide surfaces 44.

In use, the assembly 10 is coupled to a skidsteer or similar vehicle and adjusted to the desired width and depth. By driving the skidsteer in reverse, the assembly is moved over gravel 22 by moving the roller assemblies 46,62 on the guide surfaces 44. The assembly 10 as described provides for a smooth and consistent positioning of the main blade 16 relative to the shape of the frame 24 and the guide surfaces 44 as opposed to only on a level plane or being influenced by irregularities in the uneven surface on which the skidsteer is driven. The assembly 10 skims off excess gravel and provides a prepared subgrade prior to laying concrete.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A gravel grading attachment assembly comprising:

an attachment member configured for coupling to a vehicle;

a main blade coupled to said attachment member, said main blade having a straight bottom edge wherein said main blade is configured to level an upper surface of gravel positioned in a frame when said main blade is moved over the gravel;

a first roller assembly coupled to and extending from said main blade, said first roller assembly comprising a first roller defining a bottom edge of said first roller assembly, said first roller rotating in a plane substantially transverse to said straight bottom edge of said main blade;

a second roller assembly coupled to and extending from said main blade, said second roller assembly comprising a second roller defining a bottom edge of said second roller assembly, said second roller rotating in a plane substantially transverse to said straight bottom edge of said main blade wherein said first roller and said second roller are configured to rest upon spaced guide surfaces such that said straight bottom edge of said main blade is maintained at a consistent spacing relative to the guide surfaces as said first and second rollers are moved on the guide surfaces; and wherein said first roller assembly further comprises a fixed portion coupled to and extending away from said main blade, a roller adjustment plate coupled to said fixed portion, a pivotable portion pivotally coupled to said fixed portion, said first roller being coupled to said pivotable portion, and a roller adjustment arm coupled to and extending from said pivotable portion, said roller adjustment arm being coupled to said adjustment plate at a selectable position wherein said pivotable portion supports said first roller in a selected position relative to said bottom edge of said main blade when said roller adjustment arm is coupled to said roller adjustment plate.

2. The assembly of claim 1, further comprising a first side blade coupled to said main blade and said first roller assembly, said first side blade extending between said main blade and said first roller assembly, said first side blade having a straight bottom edge, said straight bottom edge of said first side blade being substantially coplanar with said straight bottom edge of said main blade.

3. The assembly of claim 2, further comprising said first roller assembly being adjustably coupled relative to said first side blade wherein a vertical distance between said bottom edge of said first roller assembly and said straight bottom edge of said main blade is adjustable.

4. The assembly of claim 2, further comprising said first side blade being slidably coupled to said main blade wherein a combined width of said main blade and said first side blade is adjustable.

5. The assembly of claim 1, further comprising a second side blade coupled to said main blade and said second roller assembly, said second side blade extending between said main blade and said second roller assembly, said second side blade having a straight bottom edge, said straight bottom edge of said second side blade being substantially coplanar with said straight bottom edge of said main blade.

6. The assembly of claim 5, further comprising said second roller assembly being adjustably coupled relative to said second side blade wherein a vertical distance between said bottom edge of said second roller assembly and said straight bottom edge of said main blade is adjustable.

7. The assembly of claim 5, further comprising said second side blade being slidably coupled to said main blade wherein a combined width of said main blade and said second side blade is adjustable.

8. The assembly of claim 1, further comprising:

a pair of pivot arms, each said pivot arm having a first end coupled to said attachment member, each said pivot arm having a second end coupled to said main blade; and a linkage member having a pair of spaced connection ends coupled to said attachment member and a blade end coupled to said main blade wherein said main blade is configured for maintaining consistent spacing relative to the guide surfaces.

9. The assembly of claim 1, further comprising a bottom surface of said main blade being angled wherein said bottom surface of said main blade extends downwardly and towards said attachment member approaching said straight bottom edge of said main blade.

10. The assembly of claim 1, further comprising said second roller assembly comprising:

a fixed portion coupled to and extending away from said main blade, a roller adjustment plate coupled to said fixed portion, a pivotable portion pivotally coupled to said fixed portion, said second roller being coupled to said pivotable portion, and a roller adjustment arm coupled to and extending from said pivotable portion, said roller adjustment arm being coupled to said adjustment plate at a selectable position wherein said pivotable portion supports said second roller in a selected position relative to said bottom edge of said main blade when said roller adjustment arm is coupled to said roller adjustment plate.

11. A gravel grading attachment assembly comprising:

an attachment member configured for coupling to a vehicle;

a main blade coupled to said attachment member, said main blade having a straight bottom edge wherein said main blade is configured to level an upper surface of gravel positioned in a frame when said main blade is moved over the gravel;

a first roller assembly coupled to and extending from said main blade, said first roller assembly comprising a first roller defining a bottom edge of said first roller assembly, said first roller rotating in a plane substantially transverse to said straight bottom edge of said main blade;

a second roller assembly coupled to and extending from said main blade, said second roller assembly comprising a second roller defining a bottom edge of said second roller assembly, said second roller rotating in a plane substantially transverse to said straight bottom edge of said main blade wherein said first roller and said second roller are configured to rest upon spaced guide surfaces such that said straight bottom edge of said main blade is maintained at a consistent spacing relative to the guide surfaces as said first and second rollers are moved on the guide surfaces;

a pair of first side receivers extending into said main blade;

said first side blade comprising a pair of spaced bars coupled to a first blade face, said bars being slidably inserted into said first side receivers wherein said first blade face is positioned adjacent to a main blade face of said main blade; and a first side locking member engaging said main blade and said first side blade wherein said spaced bars of said first side blade are prevented from sliding in said first side receivers when said first side locking member is engaged.

12. A gravel grading attachment assembly comprising:

an attachment member configured for coupling to a vehicle;

a main blade coupled to said attachment member, said main blade having a straight bottom edge wherein said main blade is configured to level an upper surface of gravel positioned in a frame when said main blade is moved over the gravel;

a first roller assembly coupled to and extending from said main blade, said first roller assembly comprising a first roller defining a bottom edge of said first roller assembly, said first roller rotating in a plane substantially transverse to said straight bottom edge of said main blade;

a second roller assembly coupled to and extending from said main blade, said second roller assembly comprising a second roller defining a bottom edge of said second roller assembly, said second roller rotating in a plane substantially transverse to said straight bottom edge of said main blade wherein said first roller and said second roller are configured to rest upon spaced guide surfaces such that said straight bottom edge of said main blade is maintained at a consistent spacing relative to the guide surfaces as said first and second rollers are moved on the guide surfaces;

a first side blade coupled to said main blade and said first roller assembly, said first side blade extending between said main blade and said first roller assembly, said first side blade having a straight bottom edge, said straight bottom edge of said first side blade being substantially coplanar with said straight bottom edge of said main blade;

a second side blade coupled to said main blade and said second roller assembly, said second side blade extending between said main blade and said second roller assembly, said second side blade having a straight bottom edge, said straight bottom edge of said second side blade being substantially coplanar with said straight bottom edge of said main blade;

a pair of first side receivers extending into said main blade;

a pair of second side receivers extending into said main blade;

said second side blade comprising a pair of spaced bars coupled to a second blade face, said bars being slidably inserted into said second side receivers wherein said second blade face is positioned adjacent to a main blade face of said main blade; and a second side locking member engaging said main blade and said second side blade wherein said spaced bars of said second side blade are prevented from sliding in said second side receivers when said second side locking member is engaged.

13. The assembly of claim 12, further comprising:

a bottom surface of said main blade being angled wherein said bottom surface of said main blade extends downwardly and towards said attachment member approaching said straight bottom edge of said main blade;

a pair of pivot arms, each said pivot arm having a first end coupled to said attachment member, each said pivot arm having a second end coupled to said main blade;

a linkage member having a pair of spaced connection ends coupled to said attachment member and a blade end coupled to said main blade wherein said main blade is configured for maintaining consistent spacing relative to the guide surfaces;

said first roller assembly comprising a fixed portion coupled to and extending away from said main blade, a roller adjustment plate coupled to said fixed portion, a pivotable portion pivotally coupled to said fixed portion, said first roller being coupled to said pivotable portion, and a roller adjustment arm coupled to and extending from said pivotable portion, said roller adjustment arm being coupled to said adjustment plate at a selectable position wherein said pivotable portion supports said first roller in a selected position relative to said bottom edge of said main blade when said roller adjustment arm is coupled to said roller adjustment plate;

said second roller assembly comprising a fixed portion coupled to and extending away from said main blade, a roller adjustment plate coupled to said fixed portion, a pivotable portion pivotally coupled to said fixed portion, said second roller being coupled to said pivotable portion, and a roller adjustment arm coupled to and extending from said pivotable portion, said roller adjustment arm being coupled to said adjustment plate at a selectable position wherein said pivotable portion supports said second roller in a selected position relative to said bottom edge of said main blade when said roller adjustment arm is coupled to said roller adjustment plate;

said first roller assembly being adjustably coupled relative to said first side roller assembly wherein a vertical distance between said bottom edge of said first roller assembly and said straight bottom edge of said main blade is adjustable, said first side blade being slidably coupled to said main blade wherein a combined width of said main blade and said first side blade is adjustable;

said first side blade comprising a pair of spaced bars coupled to a first blade face, said spaced bars of said first side blade being slidably inserted into said first side receivers wherein said first blade face is positioned adjacent to a main blade face of said main blade;

a first side locking member engaging said main blade and said first side blade wherein said spaced bars of said first side blade are prevented from sliding in said first side receivers when said first side locking member is engaged; and said second roller assembly being adjustably coupled relative to said second side roller assembly wherein a vertical distance between said bottom edge of said second roller assembly and said straight bottom edge of said main blade is adjustable, said second side blade being slidably coupled to said main blade wherein a combined width of said main blade and said second side blade is adjustable.

14. The assembly of claim 11, further comprising said first roller assembly being adjustably coupled relative to said first side blade wherein a vertical distance between said bottom edge of said first roller assembly and said straight bottom edge of said main blade is adjustable.

15. The assembly of claim 11, further comprising said first side blade being slidably coupled to said main blade wherein a combined width of said main blade and said first side blade is adjustable.

16. The assembly of claim 11, further comprising a second side blade coupled to said main blade and said second roller assembly, said second side blade extending between said main blade and said second roller assembly, said second side blade having a straight bottom edge, said straight bottom edge of said second side blade being substantially coplanar with said straight bottom edge of said main blade.

17. The assembly of claim 16, further comprising said second roller assembly being adjustably coupled relative to said second side blade wherein a vertical distance between said bottom edge of said second roller assembly and said straight bottom edge of said main blade is adjustable.

18. The assembly of claim 16, further comprising said second side blade being slidably coupled to said main blade wherein a combined width of said main blade and said second side blade is adjustable.

19. The assembly of claim 11, further comprising:

a pair of pivot arms, each said pivot arm having a first end coupled to said attachment member, each said pivot arm having a second end coupled to said main blade; and a linkage member having a pair of spaced connection ends coupled to said attachment member and a blade end coupled to said main blade wherein said main blade is configured for maintaining consistent spacing relative to the guide surfaces.

20. The assembly of claim 11, further comprising a bottom surface of said main blade being angled wherein said bottom surface of said main blade extends downwardly and towards said attachment member approaching said straight bottom edge of said main blade.

* * * * *